United States Patent [19]

Reist et al.

[11] Patent Number: 5,007,959

[45] Date of Patent: Apr. 16, 1991

[54] PROCESS FOR CONVERTING OF SOLID HIGH-GRADE COPPER MATTE

[75] Inventors: Marc Reist, Notre Dame de l'Ile Perrot; Hans Persson; Daniel Poggi, both of Pointe-Claire, all of Canada

[73] Assignee: Noranda Inc., Toronto, Canada

[21] Appl. No.: 313,884

[22] Filed: Feb. 23, 1989

[30] Foreign Application Priority Data

Apr. 29, 1988 [CA] Canada ..... 565626

[51] Int. Cl.[5] ..... C22B 15/00

[52] U.S. Cl. ..... 75/645

[58] Field of Search ..... 75/72–76, 75/643, 644, 645

[56] References Cited

U.S. PATENT DOCUMENTS 4,046,323 9/1977 McKerrow et al. ..... 75/24

4,416,690 11/1983 Richards et al. ..... 75/75

FOREIGN PATENT DOCUMENTS 2388886 12/1978 France ..... 266/268

2121830 1/1984 United Kingdom ..... 75/72

*Primary Examiner*—Melvyn J. Andrews

*Attorney, Agent, or Firm*—Fleit, Jacobson, Cohn, Price, Holman & Stern

[57] ABSTRACT

A process for the production of blister copper from high-grade copper matte or similar copper sulphide comprises the steps of solidifying and cooling molten copper matte produced in a primary smelting furnace followed by crushing of the solidified matte if necessary to produce a coarse solid matte less than about fifteen centimeters in size, heating a bath smelting reactor to a temperature at which converting reactions take place and providing a bath of molten copper, continuously feeding measured quantities of coarse solid matte and flux into the bath smelting reactor, continously introducing sufficient quantities of oxygen or oxygen enriched air through submerged fluid protected tuyeres such that the iron and sulphur present in the copper matte are oxidized, and periodically withdrawing molten blister copper, liquid slag and continously withdrawing off-gas from the bath smelting reactor.

6 Claims, 1 Drawing Sheet

PROCESS FOR CONVERTING OF SOLID HIGH-GRADE COPPER MATTE

Figure 1:
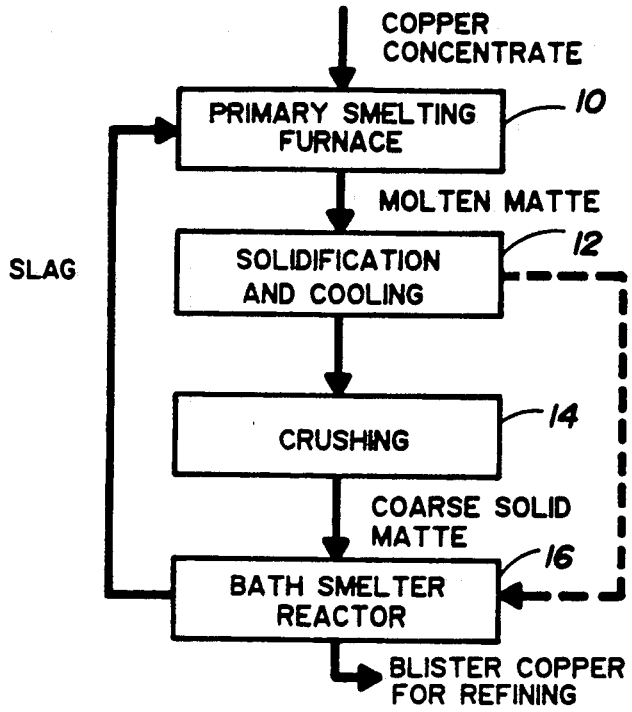

This invention relates generally to the production of blister copper by the converting of solid copper matte, and is concerned with the treatment of solid, high-grade smelting furnace matte or a similar copper sulphide such as white metal, through a converting step to copper metal, in a bath smelting reactor.

The usual way of producing blister copper is to remove iron, sulphur and some of the impurities present in smelting furnace matte by treatment of the molten matte in a two-stage batch process. This process is called converting. In the most common application of this process, molten matte is fed into a horizontal cylindrical vessel commonly referred to as a Peirce-Smith converter. Molten matte is added to the converter using ladles. Tuyeres submerged below the matte blow air or oxygen-enriched air into the matte forming a sulphur dioxide containing gas and an iron oxide containing slag. The sulphur dioxide containing gas is removed through an opening in the shell of the vessel called the mouth. The mouth is also the opening through which molten smelting furnace matte is added to, and blister copper and slag are removed from, the converting vessel. Due to the batch nature of the process, there are fugitive emissions from the ladles of molten matte each time a ladle of matte is transported to the converter, and from the converter itself each time the converter is rotated out of the blowing position. These emissions are largely comprised of sulphur bearing gases. Equipment such as secondary hoods to collect and capture fugitive emissions are complex and expensive. Fugitive emissions thus remain a fundamental deficiency of the conventional copper converting process.

The conventional Peirce-Smith converter treats molten matte produced in a primary smelting vessel. Due to the heat balance constraints, it is necessary to carry out the converting reactions using air or only slightly oxygen-enriched air (up to about 30% oxygen). Excessive amounts of converter coolant are required to maintain the operating temperature of the Peirce-Smith vessel at oxygen enrichment levels substantially greater than this level. One of the drawbacks of this requirement is that the sulphur dioxide content of the off-gas produced from the vessel is limited to a maximum of about 30% $SO_2$. This off-gas sulphur dioxide strength is further diminished by air dilution at the hood of the vessel and at other places in the off-gas train. The high volume and low strength of this gas requires large-sized gas handling equipment and makes sulphur recovery as sulphuric acid, liquid sulphur dioxide or solid elemental sulphur expensive and uneconomical. A further drawback of the batch nature of Peirce-Smith converter operation is that the converter stops blowing to charge molten matte, or remove slag or blister copper. This results in a discontinuous off-gas stream which again makes fixation of the sulphur contained in the gas more difficult and expensive.

To overcome the above problems, it has been proposed in Canadian Patent No. 1,195,125 and U.S. Pat. No. 4,415,356 to solidify the molten matte produced by the smelting furnace prior to feeding to the converting furnace. The above patents disclose a complicated and expensive operation for granulation or atomization and grinding of the matte to produce particulate matte feed to the converting furnace which is preferably a flash smelting furnace. Moreover, it is not possible to feed coarse copper-bearing materials such as scrap because the bath is not agitated, which inhibits the melting rate.

Contrary to the teaching of the above patent, the process in accordance with the present invention comprises the steps of solidifying and cooling copper matte produced in a primary smelting furnace followed by crushing of the solidified matte if necessary to produce a coarse solid matte less than about fifteen (15) centimeters in size, heating a bath smelting reactor to a temperature at which converting reactions take place and providing a bath of molten copper, feeding measured quantities of such coarse solid matte, flux and possibly copper scrap materials into the bath smelting reactor, continuously introducing sufficient quantities of oxygen or oxygen enriched air through submerged fluid protected tuyeres such that the iron and sulphur present in the copper matte are oxidized, and periodically withdrawing liquid blister copper, liquid slag and continuously withdrawing off-gas from the bath smelting reactor.

The molten copper matte may be solidified by casting into moulds on a casting machine or by casting into specially prepared pits.

The submerged injection of gases agitates the bath making it possible to melt copper-bearing materials.

The process can be carried out in a suitably modified Peirce-Smith converter equipped with appropriate feed ports and tap holes, and with fluid protected oxygen injectors in place of the usual converter tuyeres. The shielding fluid may be nitrogen gas. However a hydrocarbon gas can be employed as shrouding gas if required, for instance to melt scrap materials or increase melt temperature.

Figure 2:
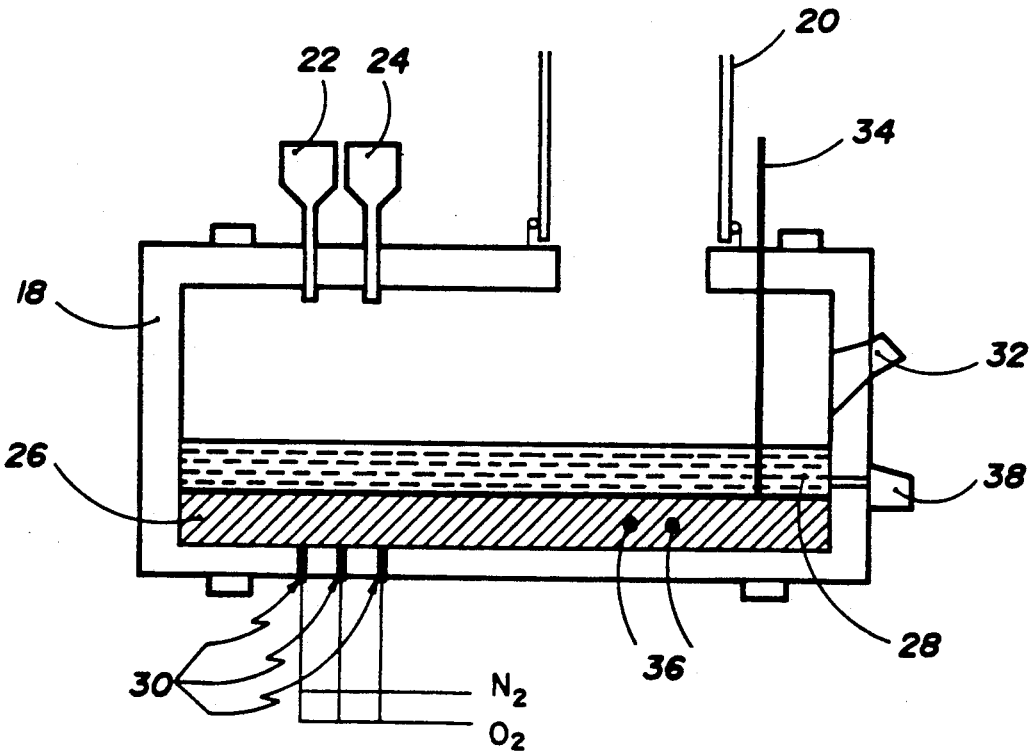

The invention will now be disclosed by way of example with reference to a preferred embodiment illustrated in the accompanying drawings in which:

FIG. 1 is a flowsheet of the process in accordance with the present invention; and FIG. 2 is a schematic diagram of a bath smelting reactor used in the converting of solid copper matte to blister copper.

Referring to FIG. 1 of the drawings, copper sulphide concentrate or other copper sulphide ore material is smelted in a conventional primary smelting furnace 10. High-grade molten copper matte containing 55–80 percent copper by weight or a similar copper sulphide such as white metal produced by the primary smelting furnace is solidified and cooled by casting into moulds on a casting machine, or specially prepared pits, as indicated schematically by solidification and cooling step 12. The solidified matte is crushed into coarse pieces, if necessary, as indicated by step 14, to produce coarse solid matte for feeding to a bath smelting reactor 16. Alternatively, matte solidified in the casting machine is fed directly to the bath smelting reactor 16 without the intermediate crushing step 14. In this case, the casting machine produces solidified matte less than about 15 centimeters in size, which passes through the bath smelting reactor feed system.

FIG. 2 of the drawings illustrates a bath smelting reactor in the shape of a horizontal generally elongated cylindrical barrel type vessel 18, similar to a Peirce-Smith converter, which is provided with a mouth covered by a sealed hood 20. Solid matte and flux are introduced into the converter by means of feed hoppers 22 and 24, respectively, mounted on the barrel of the vessel. Alternatively, matte and flux can be fed by means of a conveyor belt through a suitable opening in the hood 20. The axis of the hoppers are vertical with respect to the axis of the cylindrical vessel while it is in the blowing position. A bath of liquid blister copper 26 and slag 28 is maintained in the converter. Oxygen or oxygen enriched air is continuously injected through injectors 30 of the type disclosed in French Patent No. 1,450,718 mounted on the bottom of the barrel. Nitrogen gas is introduced through the injectors as a protective shielding gas to protect the injectors and adjacent refractory from excessive wear. Provision is made to introduce additional nitrogen if required to reduce the melt temperature, or a hydrocarbon gas such as methane if an increase in melt temperature is desired or if it is desired to melt copper scrap materials. An endwall burner 32 is also provided for heating the vessel on start-up and maintaining temperature during operation. A depth bar 34 is used to monitor the copper and slag levels in the vessel.

Blister copper is periodically discharged from the solid matte converting vessel through copper tapholes 36 on the barrel of the vessel. Slag is periodically discharged from the vessel through a slag taphole 38. The slag is tapped into ladles for recycling to the primary copper smelting furnace, such as a Noranda matte reactor. The hot gas from the furnace is continuously directed through the sealed hood 20, to a gas cooler, to dry electrostatic precipitators for dust removal and then to a plant for sulphur fixation, for example, manufacture of liquid sulphur dioxide. A syphon type gas off-take could be used instead of hood 20.

The above disclosed process and apparatus for converting of solid matte eliminates the fugitive emissions from transferring of molten matte from the primary smelting furnace. Indeed, the process in accordance with the present invention comprises feeding coarse solidifed matte instead of molten matte into the bath smelting reactor. The feed rate of solidified matte is easier to control than a feed of molten matte since solids are more easily metered. This results in less variability in temperature and bath composition and improves process control. Since the matte feed is solid, pure oxygen or very high oxygen enrichment levels can be employed in the bath smelting reactor. The use of pure oxygen or very high oxygen enrichment levels (>90% oxygen) gives rise to a much higher converting rate and increases the sulphur dioxide content in the off-gas, greatly facilitating the fixation of sulphur. The process has important economic advantages in that the Peirce-Smith converters already in use in industry can easily be modified to operate in accordance with the present invention, thus reducing the equipment cost of adopting the new technology. Furthermore, the solid matte does not need to be in the form of particles or in a finely-divided form for feeding to a flash smelting furnace as disclosed in the above mentioned Canadian patent No. 1,195,125 and U.S. Pat. No. 4,415,356. Larger coarse pieces of solidified matte up to fifteen (15) centimeters in size are produced to simplify the matte solidification operations and minimize ejection of the added solid matte by entrainment in the off-gas. Alternatively, matte can be solidified in a casting machine in shapes sufficiently small to be fed directly to the converter without crushing.

Specific examples of preferred procedures will now be given to illustrate the invention in more detail.

EXAMPLE 1

Seven-hundred and eighty-nine (789) metric tons per day of primary copper smelting furnace matte analyzing 75% Cu, 2.5% Fe, and 20.5% S (dry basis) and 1% moisture and about twenty-one (21) metric tons per day of flux analyzing 61.2% $SiO_2$, 10.0% Fe, 0.3% Cu and 6.2% S (dry basis) containing 5% moisture are continuously fed into a 3.96 meter diameter×9.15 meter long solid matte converting vessel such as shown in FIG. 2 of the drawings. One-hundred and sixty-three (163) metric tons per day of oxygen as oxygen-enriched gas (99% oxygen) are injected continuously at the rate of 4860 $Nm^3/h$ through three injectors mounted on the bottom of the barrel, along with 491 $Nm^3/h$ of nitrogen introduced as protective shielding gas to protect the injector and adjacent refractory from excessive wear, for a total blowing rate of 5351 $Nm^3/h$ at 90% oxygen. The temperatures of the molten blister copper and slag baths are maintained at about 1200 degrees Celcius.

Five-hundred and eighty-four (584) metric tons per day of copper analyzing 98% Cu and 0.5% S are discharged from the solid matte converting vessel. This product contains about 9677% of the copper contained in the copper matte fed to the furnace. Sixty-five (65) tons per day of slag analyzing 30% Cu, 29.1% Fe, and 19.4% $SiO_2$ are discharged from the vessel. The slag is tapped into ladles for recycling to the primary copper smelting furnace, such as a Noranda matte reactor. The temperature of the off-gases is about 1230 degrees Celcius. The gas from the converting reactions is exhausted continuously from the furnace at the rate of 5195 $Nm^3/h$ in a stream analyzing 87.7% $SO_2$, 10.3% $N_2$, and 1.9% $O_2$ (dry basis). This gas contains about 96.1% of the sulphur contained in the matte fed to the furnace. The hot gas is directed through a sealed hood to a gas cooler, to dry electrostatic precipitators for dust removal and then to a plant for sulphur fixation, for example, manufacture of liquid sulphur dioxide.

Mass balances are shown in Table I and the corresponding heat balance is shown in Table II.

TABLE I

Solid Matte Converting Mass Balance

| | Metric tonnes per day | Composition, % Cu | Fe | $SiO_2$ | S |
|---|---|---|---|---|---|
| Input | | | | | |
| Reactor matte | 789 | 75.0 | 2.5 | 0.0 | 20.5 |
| Flux | 21 | 0.3 | 10.0 | 61.2 | 6.2 |
| | 810 | 73.1 | 2.7 | 1.6 | 20.1 |
| Output | | | | | |
| Blister copper | 584 | 98.0 | 0.5 | 0.0 | 0.5 |
| Converter slag | 65 | 30.0 | 29.1 | 19.4 | 5.3 |
| | 649 | 91.2 | 3.4 | 1.9 | 1.0 |

Notes:
(1) Moisture content of feeds: 1% $H_2O$ in matte, 5% $H_2O$ in flux.
(2) Blowing rate: 5351 $Nm^3/h$ at 90% $O_2$.
(3) 60% of Fe occurs in converter slag as FeO.
(4) Off-gas before dilution: 5195 dry $Nm^3/h$ at 87.7% $SO_2$, 10.3% $N_2$, 1.9% $O_2$ (dry basis), and 8.2% $H_2O$ (wet basis).
(5) Oxygen utilization efficiency: 98%

TABLE II

Solid Matte Converting Heat Balance

| | Gcal/h | Distribution, % |
|---|---|---|
| Heat Input to Converter | | |
| Converting reactions | 10.18 | 99.7 |
| Net heat from fuel | 0.03 | 0.3 |
| Total heat input | 10.21 | 100.0 |
| Heat Output from Converter | | |

TABLE II-continued

| Solid Matte Converting Heat Balance | Gcal/h | Distribution, % |
|---|---|---|
| converting off-gases | 3.68 | 36.1 |
| Heat content of converter copper | 4.25 | 41.6 |
| Heat content of converter slag | 0.87 | 8.5 |
| Converter heat loss | 1.41 | 13.8 |
| Total heat output | 10.21 | 100.0 |

Notes:
(1) Converting rate: 789 tpd matte analyzing 75% Cu (see Table I)
(2) Converter heat loss of 1.41 Gcal/h
(3) 60% of Fe occurs in converter slag as FeO.
(4) Temperatures: Tapped copper, 1200° C.; off-gas before dilution, 1230° C.

EXAMPLE 2

Seven hundred and ninety-two (792) metric tons per day of copper smelting furnace matte, analyzing 74.7% Cu, 2.5% Fe, 0.4% $SiO_2$, 20.4% S (dry basis) and 1% moisture and twenty-three (23) metric tons of limestone flux analyzing 53.2% CaO (dry basis) containing 5% moisture are continuously fed into a 4.27 meter diameter×9.75 meter long solid matte converting vessel. One hundred sixty-six (166) metric tons per day of oxygen (99% $O_2$) are injected continuously at the rate of 4939 $Nm^3/h$ along with 500 $Nm^3/h$ of nitrogen as protective shielding gas to protect the injector. An endwall burner is used to supply make-up heat for the process, at a firing rate of 30 Mcal/h. Alternatively, natural gas or other gaseous hydrocarbon fuels may be introduced with shrouding gas for the oxygen injector, together with the oxygen required for combustion.

Five hundred and ninety-nine (599) metric tons of copper analyzing 98% Cu, and 0.5% S are discharged from the solid matte converting vessel. This product contains 99.3% of the copper contained in the matte introduced to the furnace. Fourty-four (44) metric tons per day of slag analyzing 10% Cu, 38.3% Fe, 6.6% $SiO_2$, 0.3% S, and 27.5% CaO are discharged from the vessel. This slag is recycled to the primary copper smelting furnace.

The converter off-gas is exhausted continuously from the furnace at the rate of 5,462 $Nm^3/h$ (dry basis) analyzing 84.5% $SO_2$, 3.7% $CO_2$, 10% $N_2$, 1.8% $O_2$ and 8% $H_2O$ (wet basis). This gas contains about 98% of the S contained in the matte fed to the solid matte converter. The hot gas is directed through a syphon-type gas off take, to a gas cooler, to dry electrostatic precipitators for dust removal and then to a plant for sulphur fixation.

Mass balances are shown in Table III and the corresponding heat balance is shown in Table IV.

TABLE III

| Mass Balance for Solid Matte Converting | Metric Tonnes per day | Composition % | | | | |
|---|---|---|---|---|---|---|
| | | Cu | Fe | $SiO_2$ | S | CaO |
| Input | | | | | | |
| Reactor matte | 792 | 74.7 | 2.5 | 0.4 | 20.4 | — |
| Limestone flux | 23 | — | — | — | — | 53.2 |
| | 815 | 72.6 | 2.4 | 0.4 | 19.8 | 1.5 |
| Output | | | | | | |
| Blister copper | 599 | 98.0 | 0.5 | — | 0.5 | — |
| Converter slag | 44 | 10.0 | 38.3 | 6.6 | 0.3 | 27.5 |

TABLE III-continued

| Mass Balance for Solid Matte Converting | Metric Tonnes per day | Composition % | | | | |
|---|---|---|---|---|---|---|
| | | Cu | Fe | $SiO_2$ | S | CaO |
| | 643 | 92.0 | 3.1 | 0.5 | 0.5 | 1.9 |

Notes:
(1) Moisture content of feeds: 1% $H_2O$ in matte 5% $H_2O$ in flux
(2) Blowing rate 5439 $Nm^3/h$ at 90% $O_2$
(3) 10% of Fe in converter slag occurs as FeO.
(4) Off-gas before dilution: 5462 dry $Nm^3/h$ at 84.5% $SO_2$, 10.0% $N_2$, 3.7% $CO_2$, 1.8% $O_2$ and 8.0% $H_2O$ (wet basis).
(5) Assumed $O_2$ utilization efficiency: 98%.

TABLE IV

| Heat Balance for Solid Matte Converting | Gcal/h | Distribution, % |
|---|---|---|
| Heat Input to Converter | | |
| Converting reactions | 10.26 | 99.7 |
| Net heat from fuel | 0.03 | 0.3 |
| Total heat input | 10.29 | 100.0 |
| Converting off-gases | 3.86 | 37.5 |
| Heat content of converter copper | 4.36 | 42.4 |
| Heat content of converter slag | 0.66 | 6.4 |
| Converter heat loss | 1.41 | 13.7 |
| Total heat output | 10.29 | 100.0 |

Notes:
(1) Converting rate: 792 tpd of matte (see Table III)
(2) Converter heat loss assumed of 1.41 Gcal/h.
(3) 10% of Fe in converter slag occurs as FeO.
(4) Temperature: Tapped copper 1200° C., off-gas before dilution, 1230° C.

Although the invention has been disclosed with reference to a preferred embodiment, it is to be understood that the invention is not limited to that embodiment but by the scope of the claim only.

We claim:

1. A process for the production of blister copper from high-grade copper matte or similar copper sulphide consisting of the steps:

(a) solidifying and cooling molten copper matte produced in a primary smelting furnace followed by crushing of the solidified matte if necessary to produce coarse particles of solid copper matte less than about fifteen centimeters in size;

(b) heating a bath smelting reactor to a temperature at which converting reactions take place and providing a bath of molten copper;

(c) continuously feeding measured quantities of said coarse particles of solid copper matte and flux into the bath smelting reactor;

(d) continuously introducing sufficient quantities of oxygen or oxygen enriched air through submerged fluid protected tuyeres such that the iron and sulphur present in the cooper matte are oxidized; and (e) periodically withdrawing molten blister copper, liquid slag and continuously withdrawing off-gas from the bath smelting reactor.

2. A process as defined in claim 1, wherein the molten copper matte from the primary smelting furnace is solidified by casting into moulds on a casting machine and is fed into the bath smelting reactor either directly, or after crushing.

3. A process as defined in claim 1, wherein the molten copper matte from the primary smelting furnace is solidified by casting into specially prepared pits.

4. A process as defined in claim 1, wherein reaction of oxygen with iron and sulphur is the principal source of heat for maintaining the temperature of the bath.

5. A process as defined in claim 1, wherein copper scrap materials are introduced into the bath smelting reactor.

6. A process as defined in claim 5, wherein hydrocarbon fuels are also introduced through said submerged fluid protected tuyeres to maintain temperature of the bath and/or provide heat for melting of net heat-consuming materials.

* * * * *